US010597986B2

(12) United States Patent
Burke et al.

(10) Patent No.: US 10,597,986 B2
(45) Date of Patent: Mar. 24, 2020

(54) METHOD AND APPARATUS FOR BI-DIRECTIONALLY ANCHORING A LINER IN A BOREHOLE

(71) Applicant: Schlumberger Technology Corporation, Sugar Land, TX (US)

(72) Inventors: Travis Raymond Burke, Spring, TX (US); James Hall, Spring, TX (US); Raghavendar Ranganathan, Houston, TX (US); Srihari Chebolu, Houston, TX (US); David E. Hirth, Pasadena, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 12 days.

(21) Appl. No.: 15/752,273

(22) PCT Filed: Aug. 3, 2016

(86) PCT No.: PCT/US2016/045247
§ 371 (c)(1),
(2) Date: Feb. 13, 2018

(87) PCT Pub. No.: WO2017/030787
PCT Pub. Date: Feb. 23, 2017

(65) Prior Publication Data

US 2018/0238151 A1 Aug. 23, 2018

Related U.S. Application Data

(60) Provisional application No. 62/206,573, filed on Aug. 18, 2015.

(51) Int. Cl.
*E21B 43/10* (2006.01)
*E21B 23/04* (2006.01)

(52) U.S. Cl.
CPC ..... *E21B 43/10* (2013.01); *E21B 23/04* (2013.01)

(58) Field of Classification Search
CPC combination set(s) only.
See application file for complete search history.

(56) References Cited

U.S. PATENT DOCUMENTS 4,096,913 A * 6/1978 Kenneday ..... E21B 23/006 166/120
4,216,834 A 8/1980 Wardlaw
4,669,538 A 6/1987 Szarka
5,086,845 A 2/1992 Baugh
(Continued)

OTHER PUBLICATIONS

International Search Report and Written Opinion for corresponding PCT Application Serial No. PCT/US2016/045247, dated Nov. 9, 2016, 14 pages.

*Primary Examiner* — Cathleen R Hutchins
*Assistant Examiner* — Ronald R Runyan

(57) ABSTRACT

A technique facilitates hanging of a liner in a borehole. According to the technique, a liner hanger and a liner may be deployed downhole into a borehole. A wellbore anchoring device of the liner hanger is initially actuated to engage a surrounding surface and to resist downward movement of the liner. Additionally, a hold down anchor is subsequently actuated to resist upward movement of the liner. The hold down anchor may be released via mechanical manipulation of the liner hanger.

15 Claims, 7 Drawing Sheets

(56) References Cited

U.S. PATENT DOCUMENTS

| | | | |
|---|---|---|---|
| 5,318,131 | A | 6/1994 | Baker |
| 6,739,398 | B1 | 5/2004 | Yokley et al. |
| 7,114,573 | B2 | 10/2006 | Hirth et al. |
| 7,225,870 | B2 | 6/2007 | Pedersen et al. |

* cited by examiner

METHOD AND APPARATUS FOR BI-DIRECTIONALLY ANCHORING A LINER IN A BOREHOLE

CROSS-REFERENCE TO RELATED APPLICATION

The present document is based on and claims priority to U.S. Provisional Application Ser. No. 62/206,573, filed Aug. 18, 2015, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing geologic formation. After a wellbore is drilled, various forms of well completion components may be installed to enable control over and to enhance efficiency of producing fluids from the reservoir. In some applications, a liner hanger and liner are deployed downhole into the wellbore, and the liner hanger is suspended from well casing deployed in the wellbore. The liner hanger may be hydraulically actuated to secure the liner hanger with respect to the casing. If actuation of the liner hanger involves a plurality of hydraulic actuating events or mechanisms, the successful sequencing of hydraulic events can be difficult to reliably achieve.

SUMMARY

In general, a methodology and system facilitate hanging of a liner in a borehole. According to an embodiment, a liner hanger and a liner are deployed downhole into a borehole. A wellbore anchoring device of the liner hanger is initially actuated, e.g. hydraulically actuated, to engage a surrounding surface and to resist downward movement of the liner. Additionally, a hold down anchor is subsequently actuated to resist upward movement of the liner. The hold down anchor is released via mechanical manipulation of the liner hanger.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
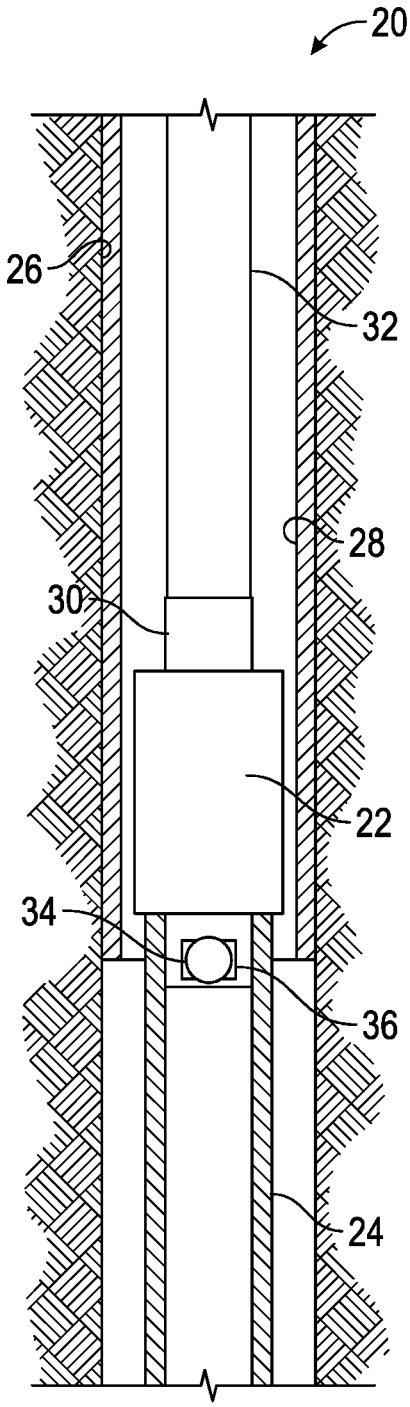
FIG. 1 is a schematic illustration of an example of a well system comprising a liner and a liner hanger deployed in a borehole, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate hanging of a liner in a borehole from, for example, a well casing. According to an embodiment, a liner hanger and a liner are deployed downhole into a borehole to a desired location, e.g. a location proximate a downhole end of a parent casing. A wellbore anchoring device of the liner hanger is initially actuated, e.g. hydraulically actuated, to engage a surrounding surface and to resist downward movement of the liner. Additionally, a hold down anchor is subsequently released and actuated to resist upward movement of the liner. The hold down anchor is released via mechanical manipulation of the liner hanger. Additionally, the hold down anchor may be actuated mechanically by, for example, a spring member released upon movement of a body of the liner hanger.

According to an embodiment, the liner is bi-directionally anchored within a wellbore following deployment downhole via a liner hanger running string, e.g. a landing string. The method of bi-directional anchoring comprises actuating the wellbore anchoring device of a liner hanger once the liner hanger and the liner are properly positioned in the wellbore. The wellbore anchoring device resists downward movement of the liner by secure engagement with the surrounding wall surface, e.g. the surrounding well casing. The running string may then be mechanically manipulated from the surface to unlock a release mechanism. The release mechanism is used to initially secure a separate hold down anchor in an unactuated position. Once the release mechanism is unlocked, the hold down anchor may be actuated mechanically to resist upward movement of the liner. After the liner and liner hanger are thus bi-directionally anchored, the liner hanger running string may be released and removed from the wellbore.

The structure of the liner hanger enables the wellbore anchoring device to initially be actuated by, for example, hydraulic actuation. After this initial actuation, however, further actuation of the liner hanger may be achieved mechanically. For example, the hold down anchor may be actuated into engagement with a surrounding casing through mechanical manipulation without application of hydraulic actuating fluid. In some applications, a release mechanism may first be mechanically actuated to release the hold down anchor. Then, further mechanical actuation, e.g. mechanical spring actuation, may be used to set the hold down anchor against the surrounding casing.

This approach is in contrast with conventional liner hanger assemblies which may use multiple hydraulic actuation events to actuate different mechanisms. In such conventional systems, additional hydraulic actuation events are achieved by raising the actuation pressure to different levels and/or spacing the hydraulic actuation events close together. In many applications, however, both of these approaches can be detrimental or difficult to implement and can lead to premature actuation and consequent difficulty in properly placing and setting the liner hanger. Closely spaced hydraulic events can lead to undesirable simultaneous actuation due to mechanical impact and hydraulic pressure spikes. If different pressure levels are used for actuation, unintentional actuation can be caused by pressure spikes during, for example, running in of the liner. The actuation sequence, including the mechanical actuation described herein can be used to avoid such instances of inadvertent actuation.

Referring generally to FIG. 1, an embodiment of a well system 20 utilizing a liner hanger 22 to suspend a liner 24 in a borehole 26, e.g. a wellbore, is illustrated. By way of example, the wellbore 26 may be cased with a casing 28 and the liner hanger 22 may be secured to the casing 28, e.g. to a lower end of the casing 28. In the illustrated embodiment, the liner 24 and liner hanger 22 are deployed downhole into borehole 26 via a liner hanger running tool 30 coupled into a running string 32, e.g. a landing string. For example, the running string 32 may be in the form of a landing string comprising drill pipe.

As described in greater detail below, components of liner hanger 22 may be selectively actuated according to a desired sequence. In some applications, an initial actuation may be performed hydraulically by applying pressure to a hydraulic actuating fluid delivered down through an interior of the running string 32. In some applications, a ball 34 may be dropped down through running string 32 and into a corresponding ball seat 36 to form a seal and to enable pressuring up within running string 32 and liner hanger 22. The ball 34 and/or ball seat 36 may then be removed, if desired, to enable fluid flow therethrough. It should be noted that ball 34 is used to represent a variety of drop-down tools which may be used to form the desired seal and ball 34 is not limited to devices in the form of a ball. For example, ball 34 may comprise a variety of spheres or semi-spherical devices, darts, plugs, or other devices shaped and constructed to form the desired seal.

Figure 2:
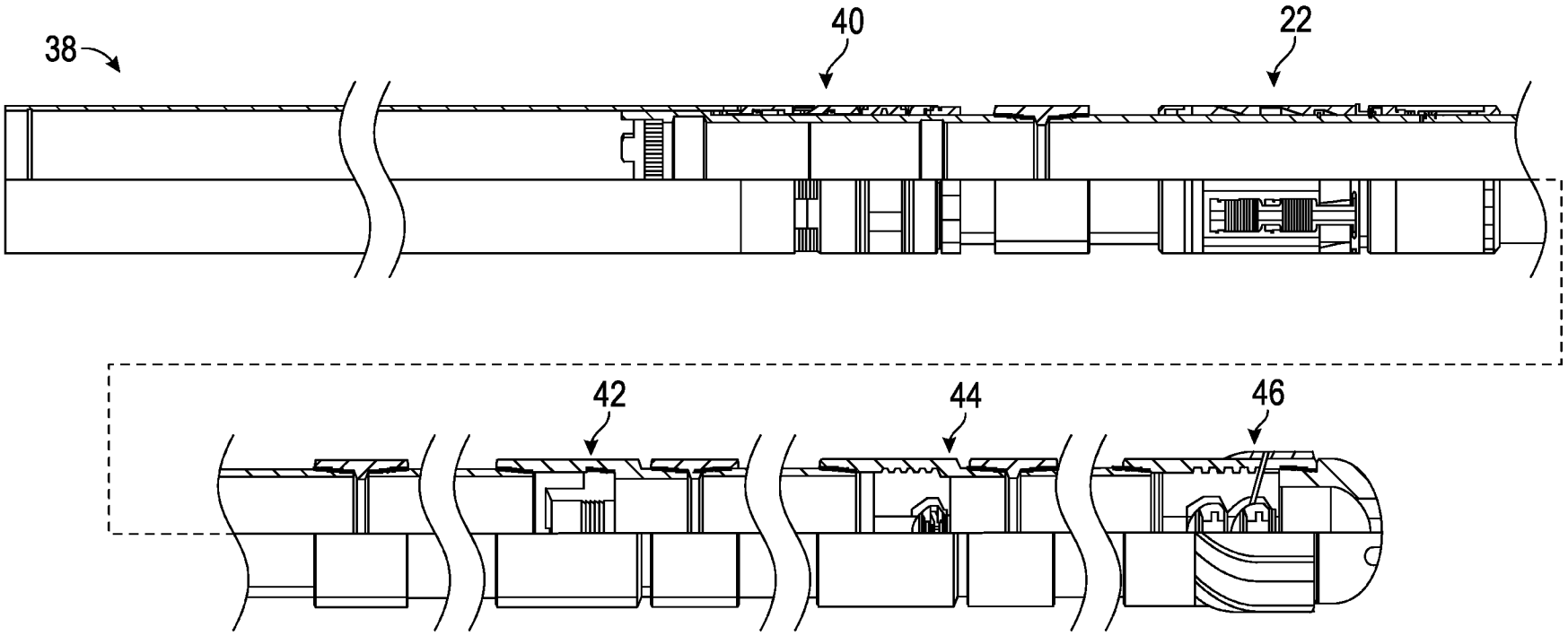
FIG. 2 is an illustration of an example of a liner hanger assembly which may be used with the well system illustrated in FIG. 1, according to an embodiment of the disclosure.
Figure 3:
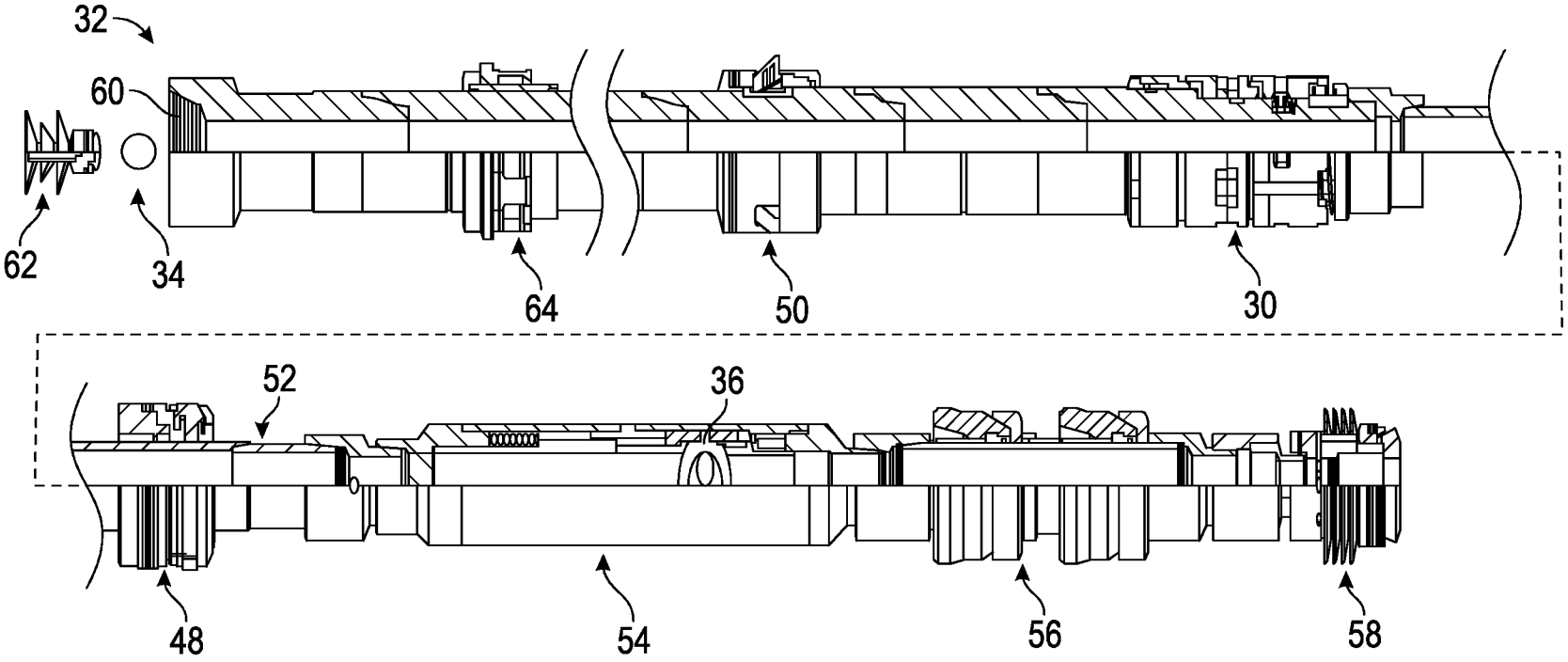
FIG. 3 is an illustration of an example of a running string assembly for deploying the liner hanger assembly, according to an embodiment of the disclosure.

Depending on the parameters of a given application, various components may be combined with liner hanger 22 and with running string 32. An example of a liner hanger system 38 incorporating liner hanger 22 is illustrated in FIG. 2. Additionally, an example of running string 32 with a variety of components is illustrated in FIG. 3. It should be noted, however, these figures provide examples and other applications may utilize additional and/or other components to provide a desired liner hanger system or running string.

Referring initially to FIG. 2, the illustrated example of liner hanger system 38 comprises liner hanger 22 positioned generally adjacent a top packer 40. The top packer 40 may be actuated to form a seal between the liner hanger system 38 and the surrounding casing 28. Examples of other components that may be combined with liner hanger 22 in system 38 include a landing collar 42, a float collar 44, and a reamer float shoe 46. However various other components may be utilized in liner hanger system 38 to facilitate a given well operation or operations.

In FIG. 3, an example of running string 32, including running tool 30, is illustrated. In this embodiment, the liner hanger running tool 30 is disposed between a retrievable cement bushing 48 and a rotating dog sub 50. The running string 32 also may comprise components such as a slick joint 52, a rotational ball seat sub 54, a swab cup assembly 56, and a liner wiper plug 58. The rotational ball seat sub 54 may comprise ball seat 36 used to receive and form a seal with ball 34. The running string 32 has an open internal passage 60 to accommodate movement of fluid and/or devices. For example, the open internal passage 60 enables the internal movement of devices such as ball 34 or a pump down plug 62. Depending on the application, the running string 32 may include a variety of other and/or additional features, such as the illustrated junk bonnet 64.

Figure 4:
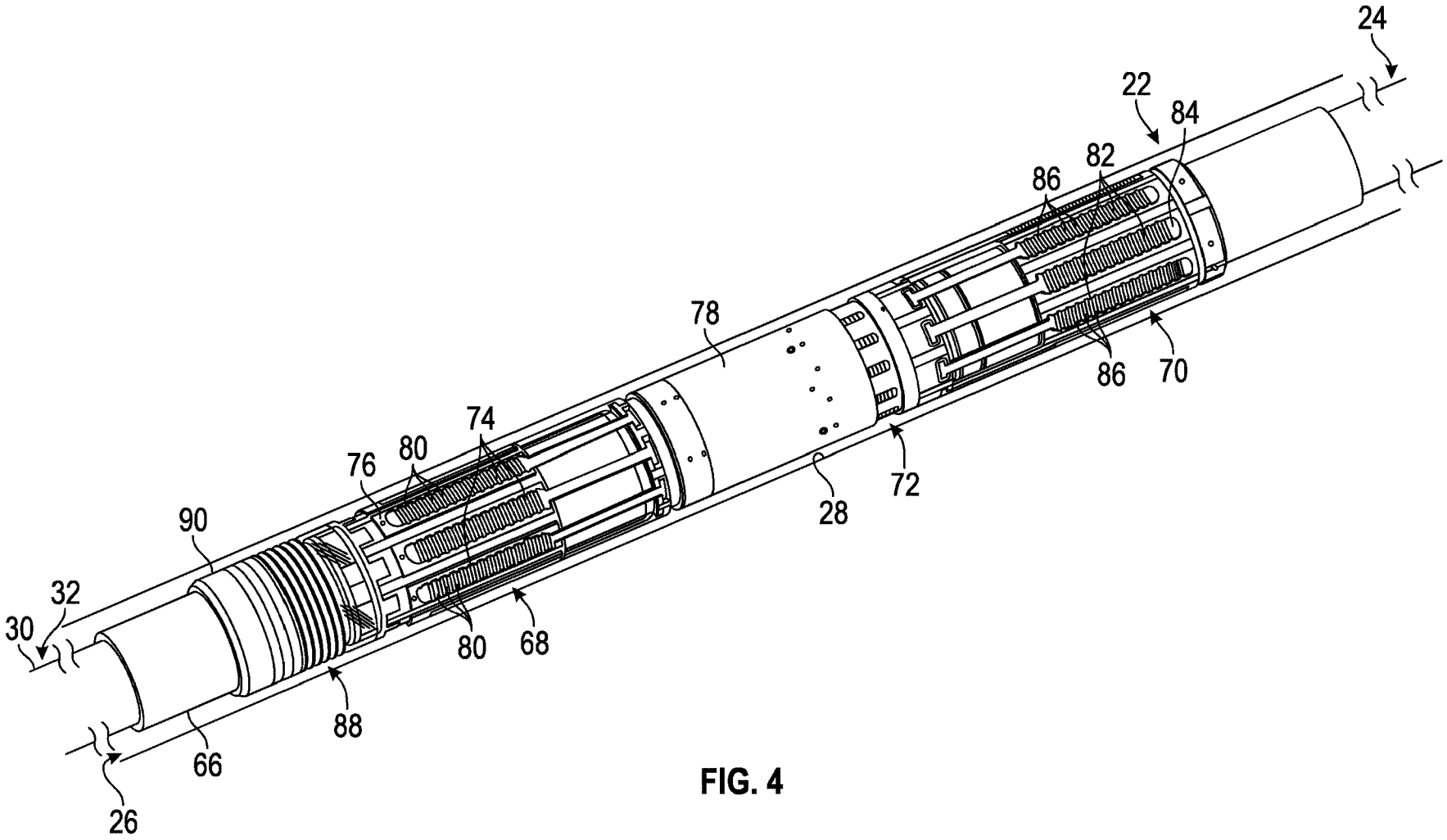
FIG. 4 is an orthogonal illustration of an example of a liner hanger which may be used in the well system illustrated in FIG. 1, according to an embodiment of the disclosure.

Referring generally to FIG. 4, an example of liner hanger 22 is illustrated. In this embodiment, the liner hanger 22 comprises an internal liner hanger body 66 to which is mounted a wellbore anchoring device 68, a hold down anchor 70, and a retention mechanism 72. Once the liner hanger 22 is moved to a desired location along borehole 26, the wellbore anchoring device 68 is actuated to secure the liner hanger 22 and liner hanger 24 against further downward travel.

According to an example, the running tool 30 of running string 32 is used to deploy liner hanger 22 and the overall liner hanger system 38 to the desired downhole location. The wellbore anchoring device 68 is then actuated via, for example, hydraulic pressure so as to drive a plurality of liner hanger slips 74 into engagement with the surrounding wall surface, e.g. into engagement with wellbore casing 28. In the illustrated example, the liner hanger slips 74 are driven against a corresponding liner hanger cone 76 by a piston 78, e.g. a cylindrical piston disposed about liner hanger body 66. As the liner hanger slips 74 are driven longitudinally by piston 78, the liner hanger cone 76 forces gripping teeth 80 of the slips 74 radially into the surrounding casing 28. Once engaged, the wellbore anchoring device 68 resists downward movement of liner hanger 22 and liner 24.

After the wellbore anchoring device 68 is actuated, hold down anchor 70 may be mechanically actuated via mechanical manipulation of the liner hanger 22 to resist upward movement of the liner hanger 22 and liner 24. As explained in greater detail below, some embodiments may utilize retention mechanism 72 to initially secure the hold down anchor 70 in an unactuated position. At a desired time, the retention mechanism 72 may be mechanically manipulated to release hold down anchor 70. Once released, the hold down anchor 70 may be actuated, e.g. mechanically actuated, and shifted into engagement with the surrounding surface, e.g. with the surrounding wellbore casing 28.

In the illustrated example, the hold down anchor 70 comprises a plurality of hold down slips 82 which are forced longitudinally against a corresponding hold down cone 84. As the hold down slips 82 are driven longitudinally, the hold down cone 84 forces gripping teeth 86 of the slips 82 radially into the surrounding surface of casing 28. Once engaged, the hold down anchor 70 resists upward movement of liner hanger 22 and liner 24.

As further illustrated in FIG. 4, the liner hanger 22 also may comprise an energy absorber 88 positioned to mitigate mechanical shocks. For example, the energy absorber 88 may be positioned generally between corresponding liner hanger cone 76 and a bearing 90 held in place by, for example, a collar. The energy absorber 88 may be in the form of a spring or shock absorber to help absorb and mitigate shocks incurred by the liner 24 and/or liner hanger 22.

Figure 5:
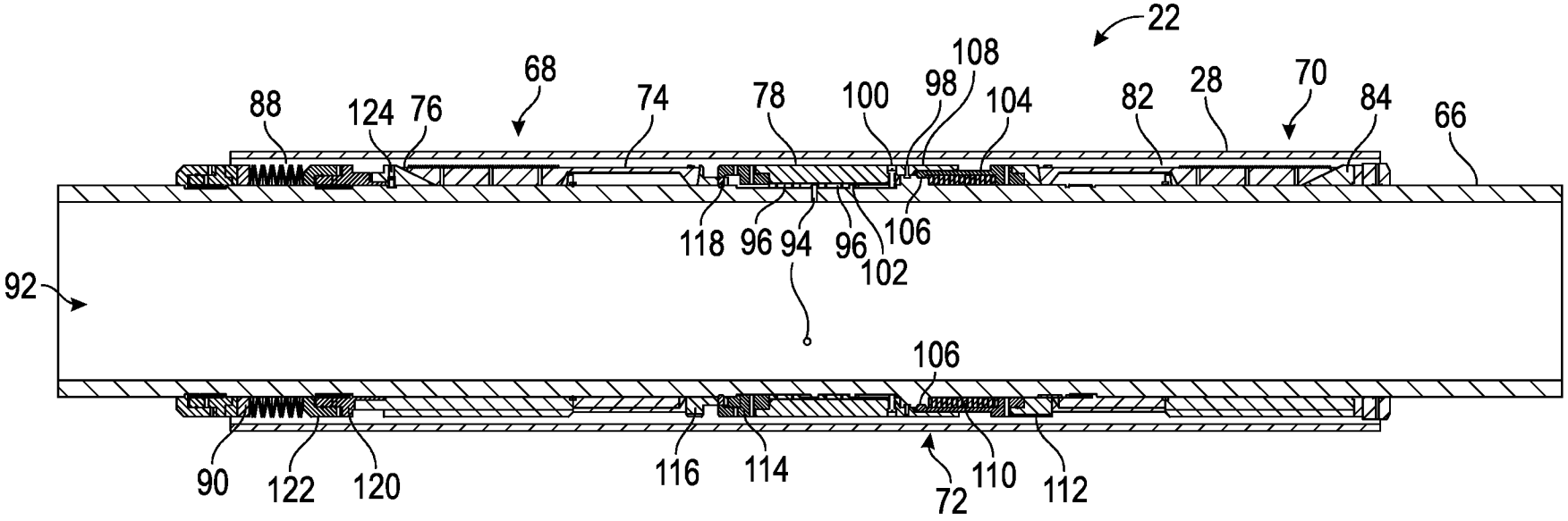
FIG. 5 is a cross-sectional view of an example of the liner hanger disposed in a run-in position within a casing, according to an embodiment of the disclosure.
Figure 6:
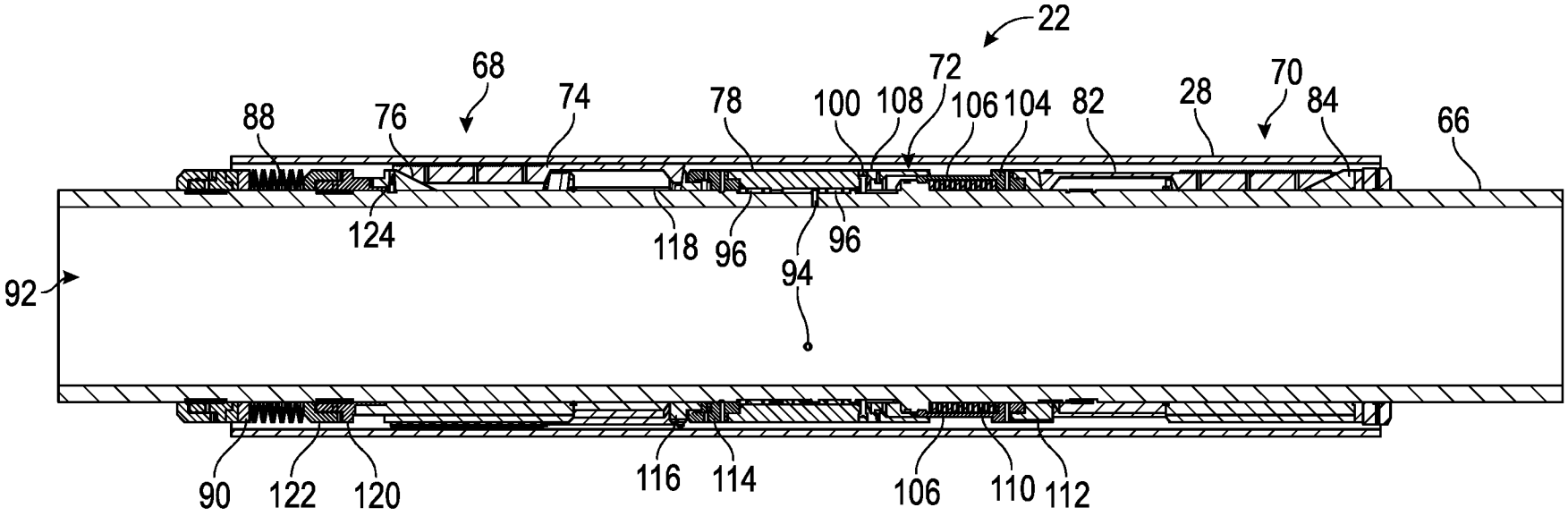
FIG. 6 is a cross-sectional view similar to that of FIG. 5 but with the liner hanger disposed in a set position within the casing, according to an embodiment of the disclosure.
Figure 7:
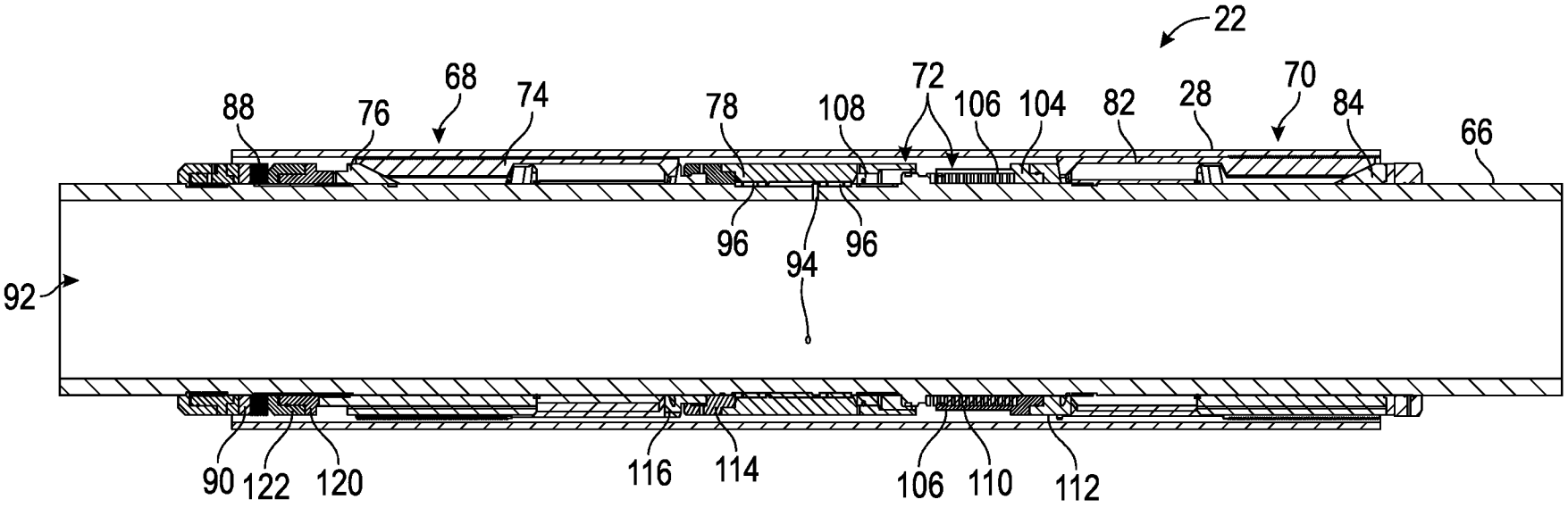
FIG. 7 is a cross-sectional view similar to that of FIG. 5 but with the liner hanger disposed in a hold down set position within the casing, according to an embodiment of the disclosure.

Referring generally to FIGS. 5-7, an embodiment of liner hanger 22 is illustrated in different operational positions to show a sequential actuation of the liner hanger 22. In this example, the liner hanger 22 comprises wellbore anchoring device 68, hold down anchor 70, and retention mechanism 72 mounted along an exterior of body 66. The liner hanger body 66 may be generally tubular in shape with an interior passage 92 which may be generally aligned with internal passage 60 of the running string 32. In this embodiment, setting of the liner hanger 22 initially comprises delivering pressurized hydraulic actuating fluid along interior passage 92 and then out to cylindrical piston 78 via ports 94. The ports 94 extend generally radially through a wall of the body 66 to a cavity formed by seals 96 located radially between body 66 and cylindrical piston 78.

In the embodiment illustrated, piston 78 is initially held in position with respect to liner hanger body 66 via a shear member 98, e.g. shear screws. The cylindrical piston 78 also is rotationally bound or locked with respect to the body 66 via at least one key 100. Each key 100 is received in a corresponding slot 102 which allows a predetermined longitudinal movement of piston 78 in an axial direction along body 66 while preventing relative rotational movement of the piston 78 with respect to liner hanger body 66.

The illustrated embodiment further utilizes retention mechanism 72 in the form of a collet 104 initially locked to liner hanger body 66 via collet arms 106. The collet arms 106 are held in a locked position engaging body 66 by a retention portion 108 of piston 78. The retention portion 108 initially extends along an exterior of the collet arms 106 so as to secure the collet arms 106 in locking engagement with body 66, as illustrated in FIG. 5. In this position, the collet 104 secures a spring member 110 in an energized state. By way of example, the spring member 110 may be in the form of a compression spring held in a compressed state by collet 104. The collet 104 is positioned in operative engagement with the hold down slips 82 via a hold down slip retainer 112.

The liner hanger 22 also may comprise other components, such as components coupling the piston 78 with liner hanger slips 74 of wellbore anchoring device 68. In the example illustrated, the piston 78 is operatively coupled with the slips 74 via a push ring 114 and a liner hanger slip retainer 116. In some applications, a body locking dog 118, e.g. a plurality of body locking dogs, may be located between push ring 114 and slip retainer 116. The locking dogs 118 retain the position of the liner hanger slips 74 and guard against presetting of the slips 74 while running in hole. Once the liner hanger 22 is positioned at depth and the piston 78 is moved upwardly, the locking dogs 118 shift radially outward to allow the push ring 114 to travel into engagement with the liner hanger slips 74 and to drive the slips 74 into engagement with wellbore casing 28.

In some embodiments, the liner hanger 22 comprises energy absorber 88 which may be in the form of a spring, such as a plurality of disk springs. The energy absorber/spring 88 may be positioned between bearing 90 and liner hanger cone 76. In some applications, a rotational clutch formed with circumferential clutch rings 120 and 122 may be located between energy absorber 88 and liner hanger cone 76.

According to an embodiment, the liner hanger cone 76 may be coupled to liner hanger body 66 via a shear member 124, e.g. shear screws. The shear member 124 may be selectively sheared to release body 66 from liner hanger cone 76 via movement of liner hanger body 66, e.g. a quarter turn or other rotational movement of the body 66. Once the liner hanger body 66 is released from liner hanger cone 76, the liner hanger body 66 is able to travel downwardly, thus energizing the energy absorber 88. In some applications, the energy absorber 88 may comprise energy absorbing rings positioned to help mitigate mechanical shock of the liner 24 decelerating after moving downwardly when shear member 124 is sheared and the liner load path is transferred through the bearing 90.

Referring generally to FIG. 5, the liner hanger 22 is illustrated in a run-in position in which the wellbore anchoring device 68 and the hold down anchor 70 are in a radially retracted state to facilitate running into the borehole 26 within casing 28. The hold down anchor 70 is secured in this unactuated state by retention mechanism 72. Similarly, piston 78 and wellbore anchoring device 68 may be secured in this unactuated state by shear member 98. With the slips 74, 82 held in this radially retracted configuration, the liner hanger 22 is readily run downhole via running string 32.

Once the liner hanger 22 is located at the desired downhole position, e.g. proximate a bottom end of casing 28, the wellbore anchoring device 68 may be actuated and set against the surrounding casing 28. To set the wellbore anchoring device 68, hydraulic actuating fluid is delivered under pressure along internal passage 60 and into interior passage 92 of liner hanger 22. In some applications, the ball 34 is initially dropped into engagement with ball seat 36 to enable pressuring up of internal passage 60 and interior passage 92 of liner hanger body 66. The ball 34 or other closure device ensures high-pressure actuating fluid flows out through ports 94 and into the piston cavity between seals 96.

The high-pressure actuating fluid causes shearing of shear member 98 and then shifting of piston 78 toward liner hanger slips 74. If body locking dogs 118 are employed between push ring 114 and slip retainer 116, the shifting of piston 78 also shifts the locking dogs 118 to enable full engagement of the push ring 114 with the slip retainer 116, as illustrated in FIG. 6. In some embodiments, travel-limiting features, e.g. key 100 captured in a limited slot 102, may be used to prevent the piston 78 from over-traveling beyond desired travel limits.

Continued application of high-pressure hydraulic actuating fluid causes further shifting of piston 78 (in a leftward direction in FIG. 6) which, in turn, forces the liner hanger slips 74 against the corresponding liner hanger cone 76. As the slips 74 are moved against the cone 76, the angled surface of the liner hanger cone 76 forces the liner hanger slips 74 in a radially outward direction and into engagement with an interior surface of casing 28, as further illustrated in FIG. 6. In this liner hanger set position, the liner hanger slips 74 and the corresponding liner hanger cone 76 become rotationally locked with respect to the casing 28. At this stage of the sequence, however, the retention portion 108 of piston 78 remains over collet arms 106 which secures collet 104 and holds spring member 110 in the energized state. In other words, the hold down anchor 70 is retained in an unactuated state and the hold down slips 82 are prevented from setting against the surrounding casing 28 until mechanically actuated.

With additional reference to FIG. 7, mechanical actuation of retention mechanism 72 and hold down anchor 70 may be described. After setting of the wellbore anchoring device 68, the liner hanger body 66 may be manipulated via liner hanger running tool 30 and running string 32. For example, the running string 32 may be used to mechanically shift liner hanger body 66 so as to release retention mechanism 72 and to enable mechanical actuation of hold down anchor 70. In some embodiments, the liner hanger body 66 may be shifted by slacking off the running string 32 to reduce tension and to allow increased weight to be transferred to the body 66, thus applying a compressive load to the body 66.

In an embodiment, the running string 32 is used to apply a compressive and/or rotational load to body 66 so as to shear the shear member 124 securing the liner hanger cone 76 to body 66. This allows the liner hanger body 66 to be moved linearly through cone 76 until the collet arms 106 are freed from the retention portion 108 of piston 78. Once the collet 104 is released, the force of compressed spring member 110 moves collet 104, slip retainer 112, and hold down slips 82 in a longitudinal direction toward hold down cone 84. In other words, the compressed spring member 110 expands in a linear direction and forces continued movement of hold down slips 82 against the corresponding hold down cone 84. As the slips 82 are moved against the corresponding cone 84, the angled surface of the cone 84 forces the hold down slips 82 in a radially outward direction and into engagement with an interior surface of casing 28, as further illustrated in FIG. 7. The mechanical movement of body 66 and spring member 110 enables selective mechanical actuation of hold down anchor 70 without application of hydraulic actuating fluid.

The sequence described above utilizes mechanical actuation to provide bi-directional anchoring of liner 24 and liner hanger 22 within borehole 26. As described, the wellbore anchoring device 68 is initially set to resist downward movement of the liner 24 along borehole 26. The wellbore anchoring device 68 may be set hydraulically, as described in the previous embodiment, or other actuation techniques may be employed. Once the wellbore anchoring device 68 is set, the running/landing string 32 may be mechanically manipulated from the surface to unlock retention mechanism 72. Unlocking retention mechanism 72 enables actuation of the hold down anchor 70, e.g. actuation via spring member 110, to resist upward movement of the liner 24 along borehole 26. After bi-directionally setting the liner hanger 22, the running string 32 and the liner hanger running tool 30 may be released and removed from borehole 26.

The methodology described herein as well as the system configuration may be adjusted according to the parameters of a given application and/or environment. For example, the liner hanger 22 may be constructed to enable hydraulic and/or mechanical actuation of wellbore anchoring device 68. Additionally, the mechanical manipulation to unlock or disable the retention mechanism 72 may comprise using: a higher amount of compression; a predetermined amount of compression held for a certain period of time; rotation applied in either the clockwise or counterclockwise direction; or combinations of these mechanical manipulation techniques.

Furthermore, the retention mechanism 72 may comprise axial or rotational motion limiting devices to secure hold down anchor 70. Examples of such motion limiting devices comprise frangible members (e.g. shear screws or shear rings), trapped dogs or collets, threads, lugs in control slots, or other devices/methods of locking and unlocking components by mechanical manipulation. The energy and motion for actuation of the hold down anchor 70 may come from a variety of sources able to provide a suitable biasing force and resulting motion. The resulting motion urges the hold down slips 82 radially outward for engagement with the interior surface of casing 28. Examples of sources able to provide the suitable biasing force comprise springs, e.g. spring member 110, downward movement of the liner 24/landing string 32, rotation in the clockwise or counterclockwise direction, hydraulics, or combinations of such biasing techniques.

Depending on the application, the hold down slips 82 may be urged axially toward the hold down cone 84 or the hold down cone 84 may be urged axially toward the hold down slips 82 to form a suitable anchor against upward movement. The energy absorber 88 also may comprise various devices or combinations of devices. For example, the energy absorber 88 may comprise mechanical, hydraulic, or other energy absorption/dissipation devices and methods.

Embodiments described herein ensure proper sequential and selective activation of the downward wellbore anchor (wellbore anchoring device 68) and upward wellbore anchor (hold down anchor 70). This type of construction enables multiple attempts at positioning the liner 24 in the wellbore 26 as desired without certain risks of unintentional actuation. The use of mechanical manipulation for unlocking the hold down anchor 70 eliminates the use of a sequenced hydraulic event and instead utilizes a dependable mechanical motion for releasing the retention mechanism 72. This approach reduces or eliminates the risk of the hold down anchor 70 prematurely activating due to unplanned downhole hydraulic pressure anomalies or activating out of sequence with regard to the hydraulic liner hanger activation.

The orientation of the hold down anchor cone 84 and slips 82 also may provide increased radial force with respect to the slip teeth 86 when tension is applied, thus providing enhanced anchoring with respect to the casing 28 in the wellbore 26. Furthermore, the liner hanger 22 may be used in many types of applications and may have a variety of different and/or additional features. Similarly, the liner hanger 22 may be used with a variety of liner hanger system 38 to facilitate hanging of liner 24 in a desired environment and application. The running string 32 also may comprise many types of components and features to facilitate a given liner hanger operation and/or other downhole operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for hanging tubing in a borehole, comprising:

deploying a liner hanger and a liner downhole into the borehole via a running string and a liner hanger running tool;

initially actuating a wellbore anchoring device of the liner hanger against a surrounding well casing to resist downhole movement of the liner, wherein initially actuating comprises using hydraulic pressure supplied along an interior of a liner hanger body for shifting a piston, which forces liner hanger slips against a corresponding liner hanger cone;

subsequently actuating a hold down anchor via mechanical manipulation of the liner hanger to resist movement of the liner; and using an energy absorber positioned between the corresponding liner hanger cone and a bearing to mitigate mechanical shocks incurred by the liner and the liner hanger.

2. The method as recited in claim 1, wherein subsequently actuating the hold down anchor comprises mechanically moving the liner hanger body via the liner hanger running tool.

3. The method as recited in claim 2, wherein mechanically moving the liner hanger body comprises releasing a collet holding a spring in a compressed state, and then using the spring energy for shifting hold down slips against a hold down cone until the hold down slips engage the surrounding well casing.

4. The method as recited in claim 1, wherein shifting the piston comprises shifting a cylindrical piston initially held in place by a shear member.

5. The method as recited in claim 4, further comprising rotationally securing the cylindrical piston with respect to the liner hanger body with a key slidably received in the liner hanger body.

6. A method, comprising:

moving a liner hanger and a liner into a wellbore with a liner hanger running string;

hydraulically actuating a wellbore anchoring device against a surrounding casing to resist downhole movement of the liner in the wellbore, wherein hydraulically actuating comprises delivering hydraulic fluid under pressure through an interior of a body of the liner hanger and using the hydraulic fluid to shift a cylindrical piston initially held in place by a shear member, which forces liner hanger slips against a corresponding liner hanger cone until engaged with the surrounding casing;

rotationally securing the cylindrical piston with respect to the liner hanger body with a key slidably received in the liner hanger body;

mechanically manipulating the liner hanger running string to unlock a retention mechanism retaining a hold down anchor in an unactuated position;

using a spring to mechanically actuate the hold down anchor so as to resist uphole movement of the liner; and removing the liner hanger running string.

7. The method as recited in claim 6, wherein mechanically manipulating comprises using the liner hanger running string to move the body of the liner hanger in a direction which releases a collet to, in turn, release the spring.

8. The method as recited in claim 7, wherein using the spring comprises pushing hold down slips against the surrounding casing, the hold down slips moving against a corresponding hold down cone.

9. The method as recited in claim 6, wherein delivering hydraulic fluid comprises delivering the hydraulic fluid through a radial port in the body and then to the cylindrical piston engaged with the liner hanger slips.

10. A system, comprising:

a liner hanger selectively actuatable for bi-directional anchoring, the liner hanger comprising:

a body;

a wellbore anchoring device mounted on the body and selectively actuatable in a borehole to resist movement of the liner hanger in a downhole direction, the wellbore anchoring device comprising a corresponding cone;

a hold down anchor mounted on the body and mechanically actuatable to resist movement of the liner hanger in an uphole direction; and a retention mechanism to prevent actuation of the hold down anchor until after the wellbore anchoring device is actuated, the retention mechanism and the hold down anchor both being mechanically actuated without application of hydraulic actuating fluid, the liner hanger further comprising an energy absorber positioned between the corresponding cone of the wellbore anchoring device and a bearing to mitigate mechanical shocks incurred by a liner and the liner hanger.

11. The system as recited in claim 10, wherein the retention mechanism is mechanically actuatable to a release position via movement of the body.

12. The system as recited in claim 11, wherein the hold down anchor is mechanically actuatable via a spring released by the retention mechanism.

13. The system as recited in claim 12, wherein the retention mechanism comprises a collet.

14. The system as recited in claim 13, wherein each of the wellbore anchoring device and the hold down anchor comprises a plurality of anchoring slips, and wherein the hold down anchor further comprises a corresponding cone.

15. A method for hanging tubing in a borehole, comprising:

deploying a liner hanger and a liner downhole into the borehole via a running string and a liner hanger running tool;

initially actuating a wellbore anchoring device of the liner hanger against a surrounding well casing to resist downhole movement of the liner, wherein initially actuating comprises using hydraulic pressure supplied along an interior of a liner hanger body for shifting a cylindrical piston initially held in place by a shear member, which forces liner hanger slips against a corresponding liner hanger cone;

subsequently actuating a hold down anchor via mechanical manipulation of the liner hanger to resist uphole movement of the liner; and rotationally securing the cylindrical piston with respect to the liner hanger body with a key slidably received in the liner hanger body.

* * * * *